US005079530A

United States Patent [19]

Tsuchiyama

[11] Patent Number: 5,079,530

[45] Date of Patent: Jan. 7, 1992

[54] CIRCUIT BREAKER WITH A SELF-ILLUMINATING POWER SWITCH

[75] Inventor: Katsutoshi Tsuchiyama, Isesaki, Japan

[73] Assignee: Hosiden Corporation, Osaka, Japan

[21] Appl. No.: 593,948

[22] Filed: Oct. 9, 1990

[30] Foreign Application Priority Data

Oct. 9, 1989 [JP] Japan ..... 1-118467[U]

[51] Int. Cl.[5] ..... H01H 73/12

[52] U.S. Cl. ..... 335/17; 200/310; 200/313

[58] Field of Search ..... 335/202, 17; 200/310–315; 337/2, 4, 8, 43

[56] References Cited

U.S. PATENT DOCUMENTS 3,435,169 3/1969 Bienwald et al. ..... 200/315

3,735,077 5/1973 Ohashi ..... 200/315

4,528,538 7/1985 Andersen ..... 377/2

4,778,967 10/1988 Deng ..... 200/315

*Primary Examiner*—Leo P. Picard

*Assistant Examiner*—Lincoln Donovan

*Attorney, Agent, or Firm*—Pollock, Vande Sande and Priddy

[57] ABSTRACT

A circuit breaker which is thermally operable and resettable and a switch connected in series to the circuit breaker are housed in a case, and the switch is operable to turn ON and OFF by its rotational movement through actuation of a switching actuator. The circuit breaker in its breaking state is driven and reset by turning ON the switch through actuation of the switching actuator. At least one portion of the switching actuator is light-transparent and a light emitting element is disposed behind the light-transparent portion.

6 Claims, 7 Drawing Sheets

CIRCUIT BREAKER WITH A SELF-ILLUMINATING POWER SWITCH

BACKGROUND OF THE INVENTION

The present invention relates to a circuit breaker with a self-illuminating power switch which can be used as a power switch for electrical equipment or electronic circuits and devices.

The applicant of this application has previously proposed a circuit breaker and a combined circuit breaker and switch structure in Japanese Utility Model Applications Laid Open Nos. 63-202037 and 2-50931.

The combined circuit breaker and switch functions simultaneously as a circuit breaker and as a power switch, and in the case where it is employed as a power switch of a device, the circuit breaker is automatically actuated to protect the device when an overcurrent flows due to a failure of the device.

With such an integrated structure, the switch and the circuit breaker are installed at one time, not separately, and the space occupied by them decreases—this attains miniaturization of the device.

FIG. 1 shows the construction of the above-mentioned combined circuit breaker and switch. Reference numeral 11 indicates a case made of an insulating material. The case 11 has its underside closed with a bottom panel 12, and a circuit breaker 20 and a switch 30 are housed in a space defined by the case 11 and the bottom panel 12.

The circuit breaker 20 comprises: a first terminal 21 planted on the bottom panel 12 in the case 11 at one corner thereof; a thermal plate 22 as of bimetal extending along the inner wall surface 11A of the case 11 but fixed at one end to the first terminal 21; a plate-like movable piece 23 coupled at one end to the free end 22A of the thermal plate 22 and extending toward the first terminal 21; a first movable contact 24 provided on the movable piece 23 near its free end; a bow-shaped spring 25 held between the free end of the movable piece 23 and the inner wall of the case 11 (the inner wall of an edge flange 13 raised from the bottom panel 12 in this example), for applying compressive force to the movable contact piece 23 lengthwise thereof; and a first fixed contact 26 provided opposite the first movable contact 24.

The switch 30 comprises; a fulcrum plate 31 fixedly mounted on the bottom panel 12; a plate-like pivotal piece 32 supported by the fulcrum plate 31 for seesawing; a second movable pivotal 33 provided on the contact piece 32 at one free end thereof; a second fixed contact 34 which is engaged with and disengaged from the second movable contact 33; a second terminal 35 for leading the second fixed contact 34 out of the case 11; a switching actuator 36 supported on the top of the case 11 so that it can seesaw about a pin 36S; and an actuating lever 37 extending from the switching actuator 36 toward the pivotal piece 32 to elastically press it. The actuating lever 37 is shown to be composed of a sleeve 37A extending from the underside of the switching actuator 36, a spring 37B housed in the sleeve 37A, and a push rod 37C which is slidably received in the sleeve 37A and is elastically pressed out therefrom by the force of the spring 37B to abut against the top surface of the pivotal piece 32.

Reference numeral 38 indicates reset means for resetting the circuit breaker 20. In this example the reset means is formed by a projecting piece 38A extending down from one free end of the switching act 36 and having a tapered edge 38B. The tapered edge 38B of reset means 38 presses the coupling portion of the thermal plate 22 and the movable contact 23 toward the inner wall 11A of the case 11 so that the circuit breaker 20 in its open state is reset to its closed state.

In this combined circuit breaker and switch, the first movable contact 24 and the first fixed contact 26 forming the breaker 20 are normally held in contact with each other by the biasing force of the bow-shaped spring 25. By actuating the switching actuator 36 in this state, the push rod 37C reciprocates on the top surface of the pivotal piece 32 lengthwise thereof, passing through its center of rotational movement, by which the pivotal piece 32 performs a stable seesaw motion with the fulcrum plate 31 as the supporting point. As a result, the second movable contact 33 and the second fixed contact 34 are brought into and out of electrical contact with each other; hence, the path between the first and second terminals 21 and 35 are switched between conducting and nonconducting states, serving as a switch.

Incidentally, a U-shaped spring piece 39 is interposed between the pivotal piece 32 and the fulcrum plate 31, by which even if the former jumps up from the latter when the switch 30 makes, their mechanical coupling is retained, thus preventing the generation of chattering between them.

When the switch 30 is actuated to be conducting, current flows between the first and second terminals 21 and 35 via the route through thermal plate 22, movable piece 23, first movable contact 24, first fixed pivotal 26, fulcrum plate 31, contact piece 32, second movable contact 33, second fixed contact 34, and second terminal 35, sequentially, in this order.

When the current exceeds a predetermined value, the thermal plate 22 generates heat by the Joule's heat and starts bending with the heat. In the illustrated example the thermal plate 22 is deformed so that its free end 22A shifts toward a stopper 14 protrusively provided on the bottom panel 12.

As the free end 22A of the thermal plate 22 moves toward the stopper 14, the movable piece 23 will be forced to turn about the first fixed contact 26. As a result of this, the point of engagement between the movable piece 23 and the bow-shaped spring 25 shifts toward the outside of a line joining the point of contact between the first movable contact 24 and the first fixed contact 26 and the point of engagement between the bow-shaped spring 25 and the edge flange 13 (that is, toward the inner wall 11A of the case 11).

Once the point of engagement between the movable piece 23 and the bow-shaped spring 25 goes beyond the line joining the point of contact between the first movable contact 24 and the first fixed contact 26 and the point of engagement between the spring 25 and the edge flange 13, the direction of the lateral biasing force of the spring 25, that is, the direction of force by which the first movable contact 24 is urged against the first fixed contact 26, is reversed and the point of engagement between the movable piece 23 and the spring 25 leaps toward the inner wall 11A of the case 11, disengaging the first movable contact 24 from the first fixed contact 26 to provide nonconduction between the first and second terminals 21 and 35.

At this time, the free end portion of the movable piece 23 coupled with the free end 22A of the thermal plate 22 engages the stopper 14, and by its reaction force, the point of engagement between the spring 25 and the movable piece 23 remains greatly biased toward the inner wall 11A of the case 11. This state is retained even after the temperature of the thermal plate 22 drops down to its initial temperature.

When actuating the switching actuator 36 to turn off the switch 30 after the temperature of the thermal plate 22 has returned to the initial temperature, the tapered edge 38B of the projecting piece 38A forming the reset means 38 engaged coupled the free ends of the thermal plate 22 and the movable piece 23 and pushes them toward the inner wall 11A of the case 11. When the free end of the movable piece 23 is moved out of the line joining the point of engagement between the movable piece 23 and the spring 25 and the point of engagement between the spring 25 and the edge flange 13 of the case 11, the lateral biasing force of the spring 25 is reversed in direction, bringing the first movable contact 24 into contact with the first fixed contact 26 and hence resetting the switch 30.

In the circuit breaker 20 the top end of the first terminal 21 is extended upward to form a projecting piece 27, which is received in a hole 15 made in the top panel of the case 11. The breaking characteristic (quick-break, slow-break) of the circuit breaker 20 is controlled through adjustment of the direction of the thermal plate 22 by turning the projecting piece 27 with a jig.

With the combined circuit breaker and switch unit described above, a pilot lamp for indicating power supply must be provided separately of the unit. This requires a site for attachment of the pilot lamp and involves work for its installation.

Besides, when the combined circuit breaker and switch unit is used as a power switch at a dark place, it is necessary to provide a light source for illuminating the position of the switching actuator of the switch.

SUMMARY OF THE INVENTION

It is therefore an object of the present invention to provide a circuit breaker with a self-illuminating power switch which is capable of indicating power supply without the need of separately providing a pilot lamp and is capable of indicating the position of the unit itself.

According to the present invention, in the aforementioned combined circuit breaker and switch unit the switching actuator is wholly or partly molded using a light-transparent resin, and a light source is disposed behind the portion made of the light-transparent resin to illuminate the switching actuator from the inside thereof.

In the circuit breaker with a self-illuminating power switch according to the present invention, when the switch and the circuit breaker are both in the ON state, the light source is lighted to indicate power supply. This indication is produced by illuminating light-transparent portion of the switching actuator.

DESCRIPTION OF THE PREFERRED EMBODIMENTS

Figure 1:
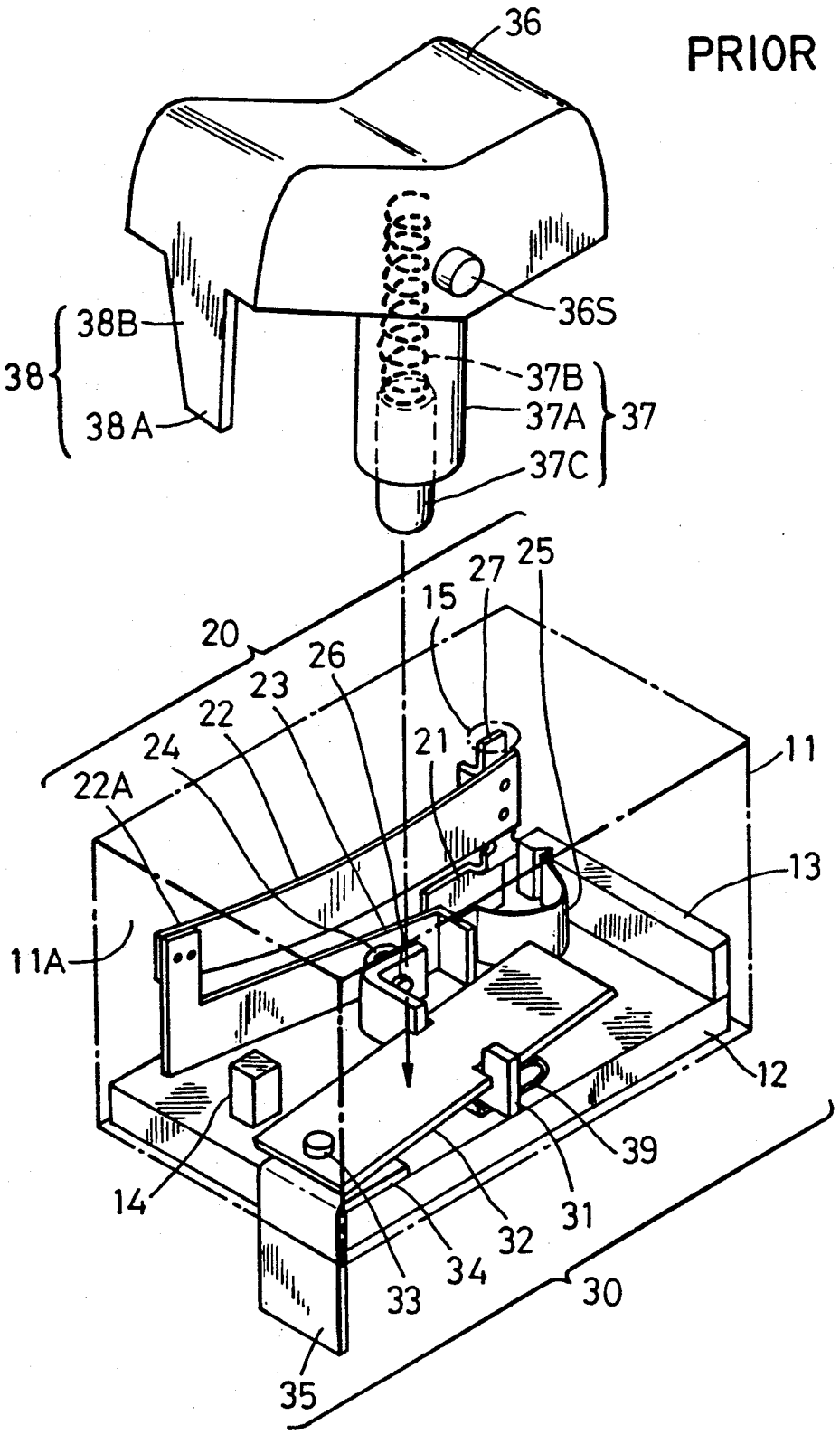
FIG. 1 PRIOR ART
FIG. 1 is a perspective view showing a prior art combined circuit breaker and switch.

FIGS. 2 through 9 illustrates embodiments of the circuit breaker with a self-illuminating power switch according to the present invention. The parts corresponding to those in FIG. 1 are identified by the same reference numerals and therefore no detailed description will be given relating to them in the interests of brevity.

According to the present invention, the switching actuator 36 is wholly or partly molded using a light-transparent resin, and a light emitting element 40 is provided in the case 11 near its top. More specifically, the light emitting element 40 is disposed behind the light-transparent portion of the switching actuator 36.

Figure 3:
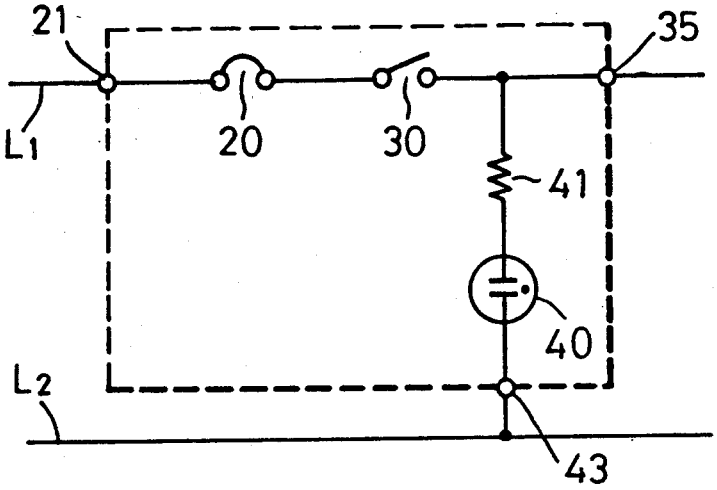
FIG. 3 is a circuit diagram for explaining the connection of a light emitting element to a switch and a circuit breaker.

The light emitting element 40 in this example is shown to be a neon tube. To light the neon tube from, for example, the commercial power source, a resistor 41 is connected in series with the neon tube and the series circuit is connected in parallel between power lines $L_1$ and $L_2$ as shown in FIG. 3 In this instance, one end of the resistor 41 and one of two lead wires of the light emitting element 40 are caulked and connected together by a caulking-connecting ring 42 and the light emitting element 40 has its other lead wire caulked together with a third terminal 43 installed in the case 11.

The rectangular bottom panel 12 has holes for receiving the third terminal 43 and the lead wire of the resistor 41. After installation of the circuit breaker 20 and the switch 30 in the case 11 the third terminal 43 and the lead wire of the resistor 41 are inserted into the above-mentioned holes in the bottom panel 12 from above and are led out onto the underside of the bottom panel 12.

The lead wire of the resistor 41 is bent along the underside of the bottom panel 12 toward the second terminal 35 and is pressed into a slot made in a projecting piece 35A extending from the second terminal 35 and projecting out onto the underside of the bottom panel 12. Thus, the lead wire of the resistor 41 is electrically and mechanically connected to the second terminal 35.

Figure 2:
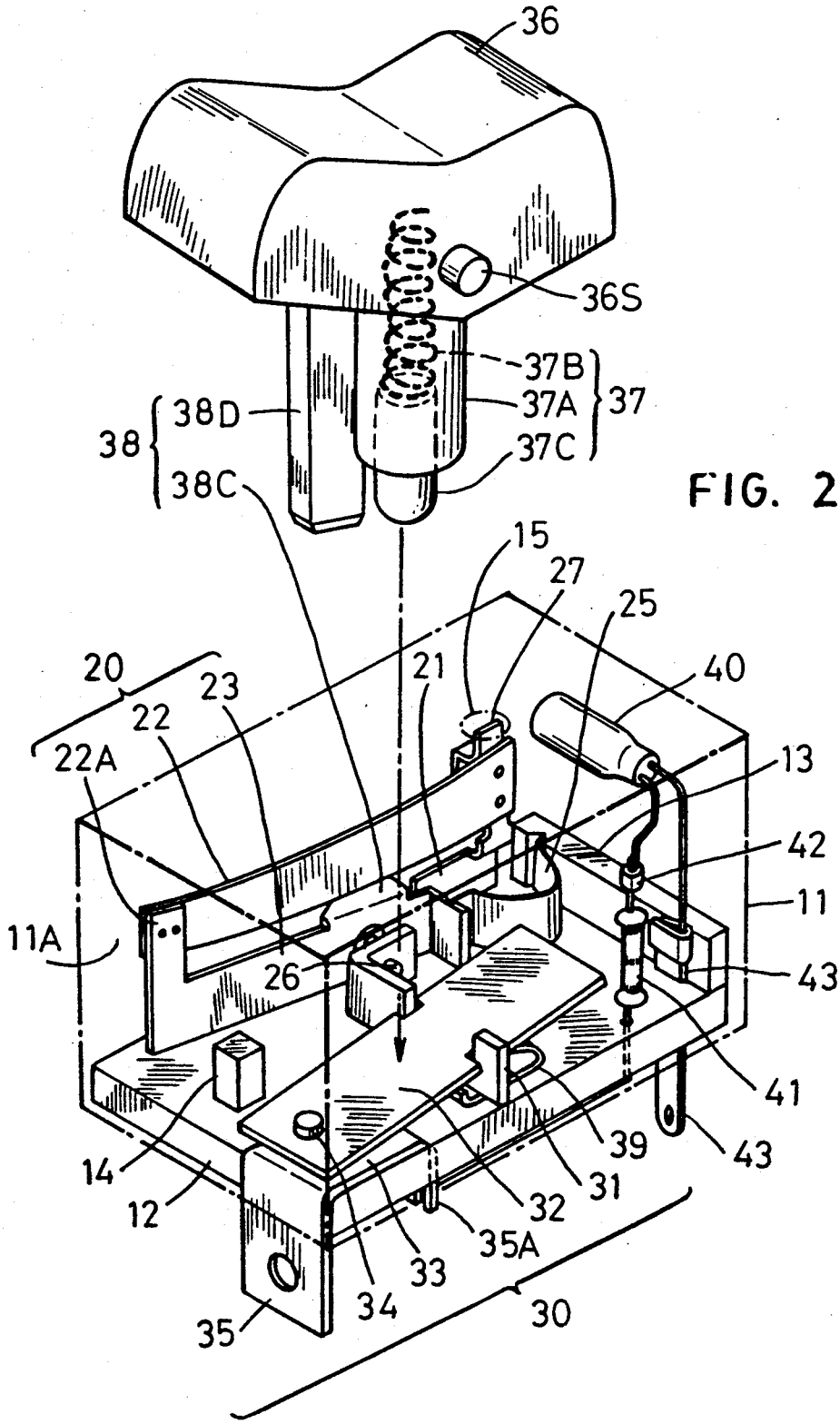
FIG. 2 is a perspective view illustrating an embodiment of the present invention.

In the embodiment shown in FIG. 2 the reset means 38 is shown to be formed by a cam 38C made integrally with the movable contact piece 23 and an actuating lever 38D for actuating the ca 38C.

The cam 38C is provided by forming a protrusion along the marginal edge of the movable piece 23 near the end thereof which is engaged with the spring 25 and bending the protrusion toward the inner wall 11A of the case 11. The actuating lever 38D extends down from the underside of the switching actuator 36 and into a gap between the inner wall 11A of the case 11 and the movable piece 23 and, in this gap, the lever 38D is turned in a plane along the longitudinal direction of the movable piece 23. When the breaker 20 is operative, the tip end of the cam 38C deeply crosses the plane of turning of the lever 38D obliquely thereto and is urged toward the first fixed contact 26 as the lever 38D turns.

When the circuit breaker 20 is operative, the cam 38C lies near the inner wall 11A of the case 11. Actuating the switching actuator 36 to turn it ON in this state, the drive lever 38D turns into sliding contact with the tip end edge of the cam 38C to press it toward the first fixed contact 26, by which the point of engagement between the spring 25 and the movable contact piece 23 is shifted away from the inner wall 11A. As a result of this, the lateral force by the spring 25 is reversed in direction, returning the circuit breaker 20 into its closed state. Because of this arrangement, to reset the circuit breaker 20 when it is in an open state, the cam 38C need not be driven as great a distance as in the case of the prior art arrangement shown in FIG. 1, in which the free end 22A of the thermal plate 22 has to be driven away from the inner wall surface 11A a large distance to reset the circuit breaker 20. According to the present invention, therefore, a more reliable resetting operation is attainable with a shorter lateral displacement of the movable piece 23.

Figure 4:
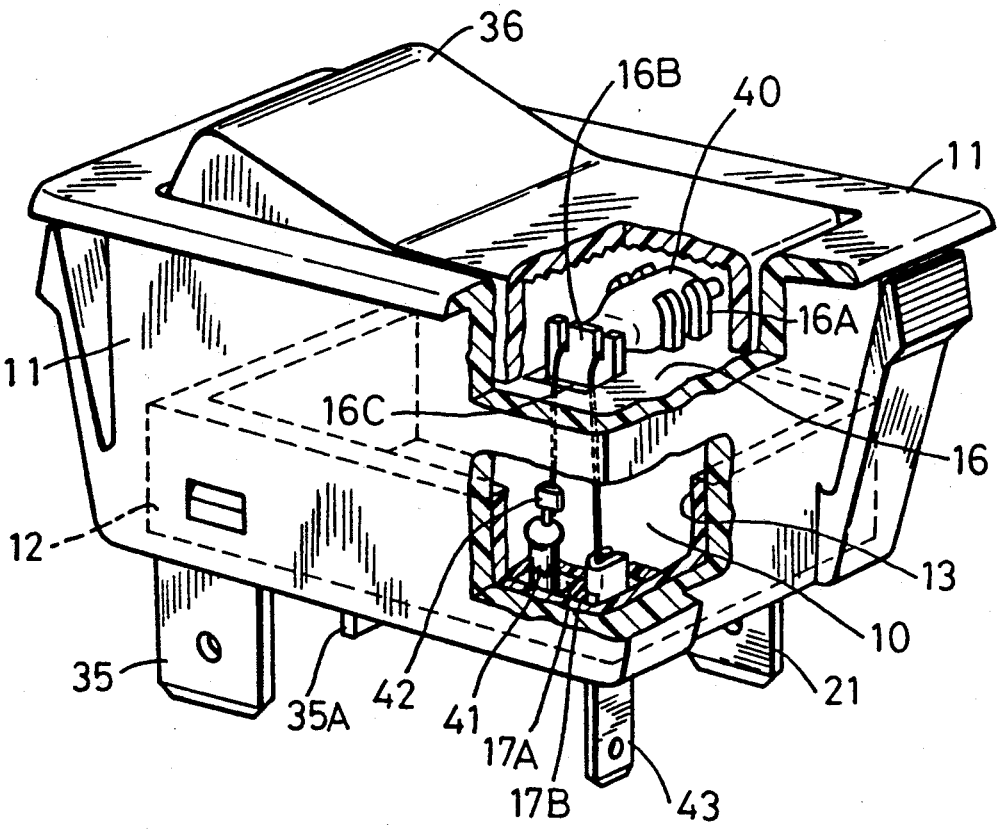
FIG. 4 is a perspective view, partly cut away, showing an example concrete structure of the present invention.

FIG. 4 illustrates, by way of example, a concrete structure for packaging the light emitting element 40, the resistor 41 and the third terminal 43. The light emitting element 40 is fixedly held between arms 16A formed integrally with a ceiling 16 of the case 11.

The lead wires of the light emitting element 40 are inserted and fixed in slits made in a holder 16B and are inserted into a circuit breaker housing compartment 10 through a hole 16C made in the ceiling 16. The lead wires of the light emitting element 40 have connected thereto the third terminal 43 and the resistor 41, respectively, as referred to previously, and their lead wires pass through the compartment 10 and are led out onto the underside of the bottom panel 12 through holes made therein.

The third terminal 43 thus led out onto the underside of the bottom panel 12 has its projecting portion twisted and hence is fixed to the bottom panel 12. The lead wire of the resistor 41 is bent along the underside of the bottom panel and is connected to the projecting piece 35A extended from the second terminal 35.

Inside the case 11 the resistor 41 and the third terminal 43 are received in tubular portions 17A and 17B made in the bottom panel 12 so that they are held out of contact with each other.

In the example depicted in FIG. 4, the switching actuator 36 is wholly formed of a colored light-transparent resin and its interior surface is made uneven for diffusing light. The light emitting element 40 illuminates that half portion of the switching actuator 36 on the side where the switch 30 has been turned ON, it indicates the ON state of the switch 30.

Figure 5:
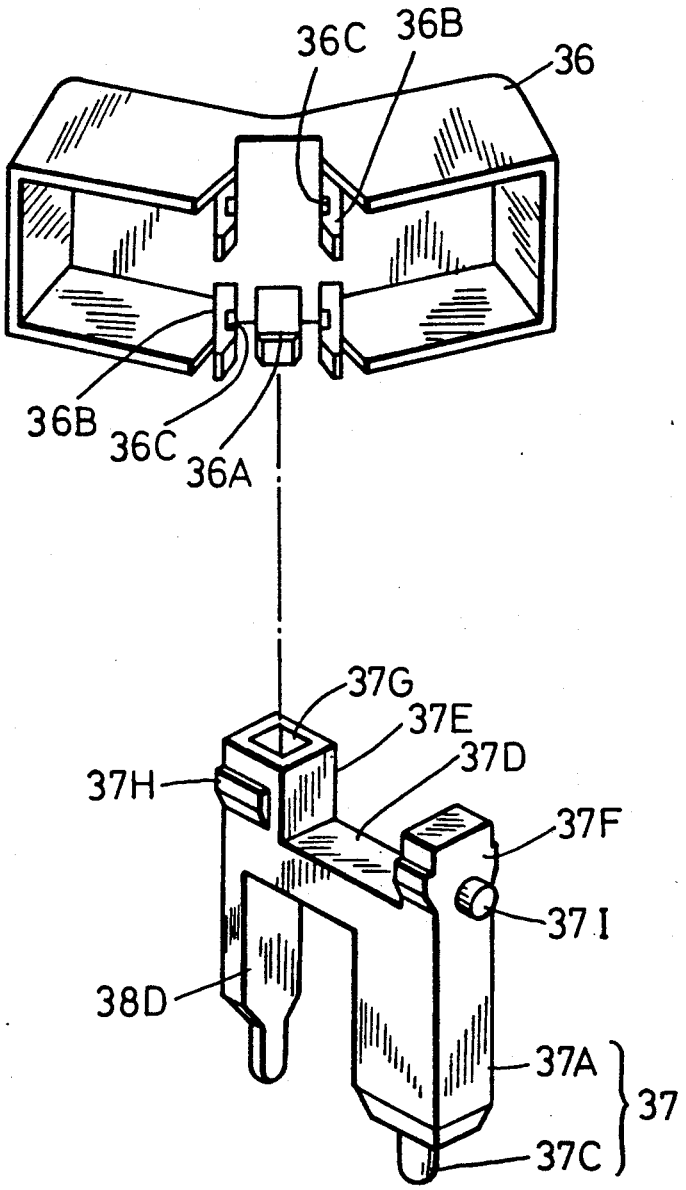
FIG. 5 is an exploded perspective view for explaining the structure for coupling together a switching actuator and actuating levers employed in the embodiment of the present invention.
Figure 6:
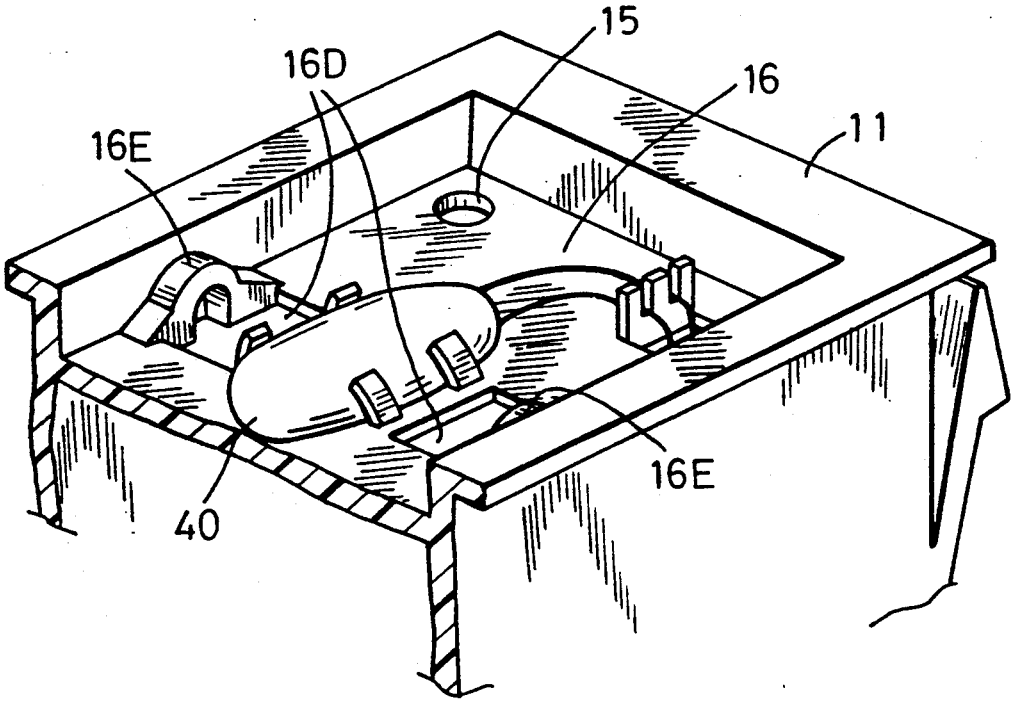
FIG. 6 is a perspective view showing the structure of the case body to which the actuating levers depicted in FIG. 5 are journaled.

FIG. 5 shows the switching actuator 36, the actuating lever 37 and the drive lever 38D forming the reset means 38, and FIG. 6 shows, by way of example, a concrete structure of that portion of the case 11 for supporting the levers 37 and 38D.

The actuating lever 37 and the drive lever 38D have their upper ends coupled together by a coupling member 37D so that they form an H-letter configuration. The coupling member 37D has upward projecting portions 37E and 37F. The projecting portion 37E has a square hole 37G for receiving a projection 36A extending from the underside of the switching actuator 36. The projecting portions 37E and 37F have on their opposite sides protrusions 37H for engagement with grooves 36C cut in two pairs of opposed projecting pieces 36B provided on the underside of the switching actuator 36. By the engagement of the protrusions 37H with the grooves 36C, the actuating lever 37 and the drive lever 38D are fixed to the underside of the switching actuator 36.

On the other hand, the ceiling 16 of the case 11 has a pair of square holes 16D as shown in FIG. 6 and bearings 16E formed integrally with both side walls of the case 11 adjacent the holes 16D, respectively. The bearings 16E receive pins 37I protrusively provided on side faces of the levers 37 and 38D. That is to say, prior to fitting the switching actuator 36 into the case 11, the levers 37 and 38D are inserted into the case 11 from below and the projecting portions 37E and 37F are projected out of the square holes 16E made in the ceiling 16 and then the pins 37I are fitted into the bearings 16E. After this, the switching actuator 36 is fitted into the case 11 so that the projecting portions 37E and 37F are held between the two pairs of the projecting pieces 36B.

In the example shown in FIG. 6 the light emitting element 40 is disposed between the two holes 16D to illuminate the switching actuator 36 as a whole. In this instance, the lengths of the projecting portions 37E and 37F formed on the actuating lever 37 and the drive lever 38D, respectively, are selected such that their top ends do not contact the underside of the switching actuator 36. With such a structure, the top ends of the projecting portions 37E and 37F and the underside are spaced apart and light enters therebetween, preventing shadows of the projecting portions 37E and 37F from being projected during illumination of the switching actuator 36.

Figure 7:
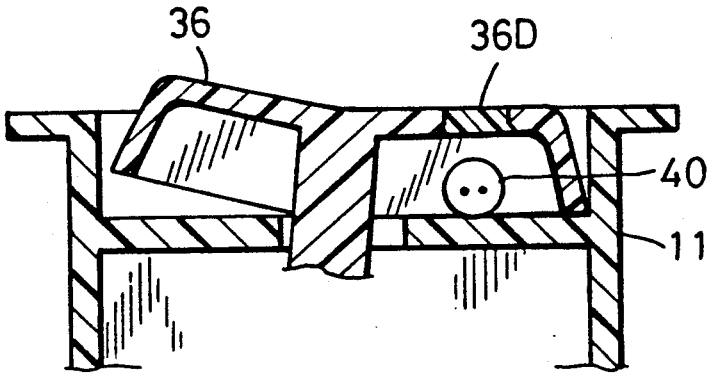
FIG. 7 is a sectional view illustrating a modified form of the present invention.
Figure 8:
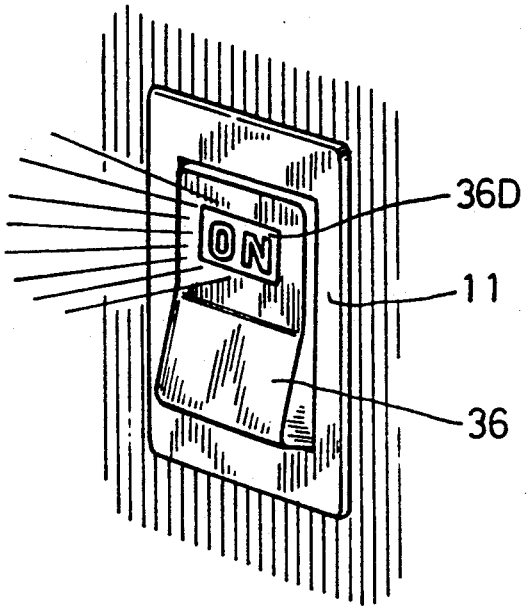
FIG. 8 is a perspective view showing an example of its use.

FIG. 7 illustrates a modified form of the present invention in which the switching actuator 36 is molded using a light shielding resin and a light-transparent resin 36D is fitted in a window made in one of the actuating portions of the actuator 36. The light-transparent resin covering the window may be made to bear letters indicating power supply as shown in FIG. 8.

Figure 9:
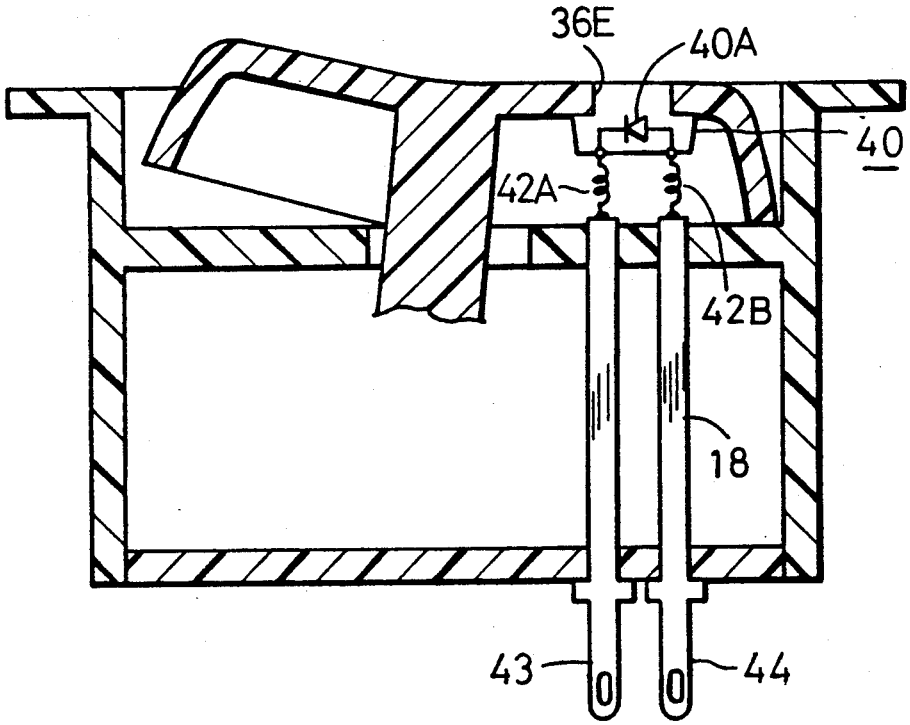
FIG. 9 is a sectional view illustrating another embodiment of the present invention.
Figure 10:
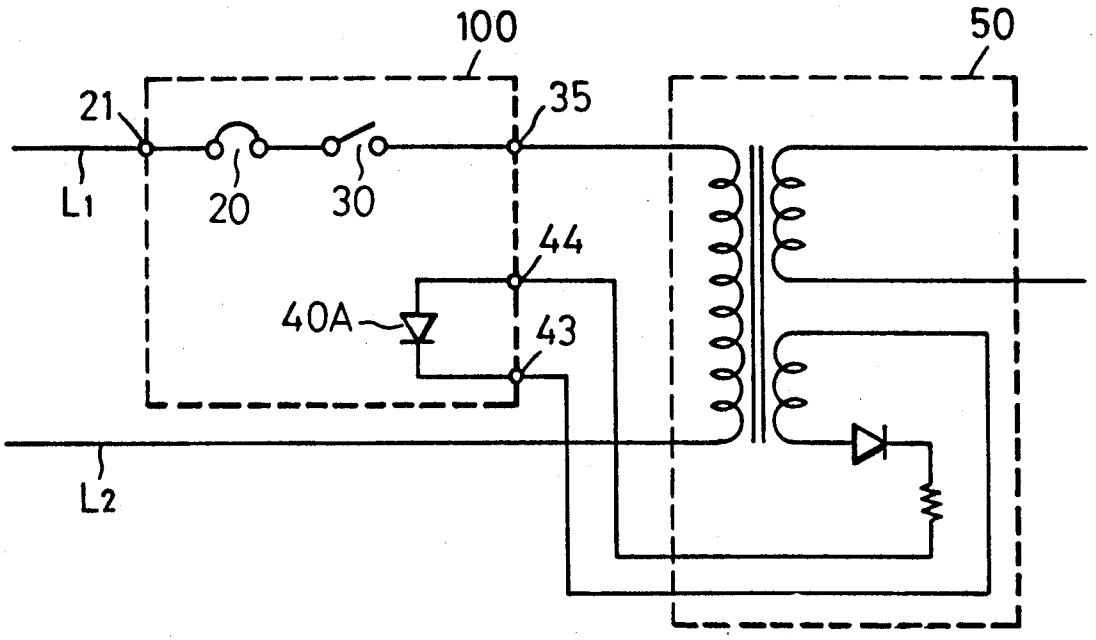
FIG. 10 is a circuit diagram showing the connection between the embodiment of FIG. 9 and a device.

FIG. 9 shows the case where the light emitting element 40 is a light emitting diode. In this instance, the switching actuator 36 is molded using the light shielding resin and has a window 36E formed in one of its actuating portions and fitted with the light emitting element 40 having housed therein a light emitting diode 40*a*. The light emitting diode 40A has its both ends connected to the terminals 43 and 44 via elastic lead coils 42A and 42B. As shown in FIG. 10, a DC voltage $V_{DC}$ is supplied across the terminals 43 and 44 from a power supply 50 of a device with which the circuit breaker with a power switch according to the present invention is used as indicated by 100. The lead coils 42A and 42B may also be spring coils of weak force, in which case it is possible to employ an arrangement in which only when the switching actuator 36 is held at the position where the switch 30 is turned ON, the spring coils make at one end free contact with the terminals 43 and 44 or terminals of the light emitting diode 40*a*.

As described above, the present invention offers a circuit breaker with a power switch which has the power supply indicating function. In other words, the unit of the present invention is an integration of a power switch, a circuit breaker and a pilot lamp. Hence, the combined circuit breaker and power switch structure with a pilot lamp according to the present invention occupies less space than in the past.

When the combined structure of the present invention is mounted on a device which is used at a dark place, there is no need of providing a light source for indicating the position of the power switch.

With a structure in which the light emitting element 40 is installed by previously caulking the resistor 41 and the third terminal 43 to the lead wires of the light emitting element 40, inserting the lead wire of the resistor 41 and the third terminal 43 through the holes made in the bottom panel 12, connecting the lead wire of the resistor 41 to the second terminal on the outside of the case 11 and then twisting the third terminal 43 to prevent it from coming off, the light emitting element 40 can be incorporated into the case 11 after incorporation therein of the circuit breaker 20 and the switch 30.

Consequently, combined circuit breaker and power switch structures need not be split into the illuminating type and the non-illuminating type from the beginning and the circuit breaker with the self-illuminating power switch can be produced as required, after the circuit breaker 20 and the switch 30 are installed in the case 11. This allows ease in production control.

It will be apparent that many modifications and variations may be effected without departing from the scope of the novel concepts of the present invention.

What is claimed is:

1. A circuit breaker with a self-illuminating power switch, comprising:

(a) a substantially rectangular parallelpipedic case formed of an insulator and having a bottom panel;

(b) a first terminal planted on said bottom panel for connection to a feeder;

(c) a thermal plate mounted in said case to extend along an inner wall surface of said case, said thermal plate being fixed at one end thereof to said first terminal;

(d) an elongated movable metal plate connected at one end thereof to the other end of said thermal plate, said movable metal plate extending from its said one end towards said first terminal and having, near the other end there, a resetting cam formed integrally therewith to extend laterally thereof towards said inner wall surface of said case;

(e) a bow-shaped spring engaging said other end of said movable metal plate for applying pressure to said movable metal plate lengthwise thereof;

(f) a first fixed contact disposed adjacent a side of said movable metal plate opposite from said resetting cam and in opposing relation to said movable metal plate near said other end thereof, said first fixed contact being fixed to said bottom panel, said movable metal plate engaging said first fixed contact in the ON condition of said circuit breaker and being moved out of contact with said first fixed contact to an OFF condition of said circuit breaker by a warping of said thermal plate due to heat generation therein;

(g) a pivotal metal piece electrically connected to said first fixed contact and supported for seesaw motion;

(h) a second fixed contact fixedly mounted on said bottom panel opposite one end of said pivotal metal piece to form said power switch, said second fixed contact having a second terminal for outputting power from said first terminal;

(i) an actuating lever having a lower end which slidably abuts the top surface of said pivotal metal piece and elastically presses against said pivotal piece, an upper end of said actuating lever being pivotally supported on said case for driving said pivotal metal piece in a seesaw motion;

(j) a switching actuator coupled to said upper end of said actuating lever for moving said actuating lever, said switching actuator having an actuation surface exposed at the top of said case, at least one portion of said actuation surface being light transparent;

(k) a rod like drive means fixed to said switching actuator to extend into a space defined between said movable metal plate and said inner wall surface of said case, said drive means being movable in a plane parallel to said inner wall surface for slidable engagement with a marginal edge of said resetting cam in an oblique direction to drive said movable metal plate towards said first fixed contact when said switching actuator is actuated; and (l) light emitting means provided behind said switching actuator for emitting light through said light-transparent portion, and light emitting means being turned ON and OFF in response to the engagement and disengagement between said pivotal metal piece and said second fixed contact.

2. The circuit breaker of claim 1, wherein said switching actuator is formed of a light-transparent resin, the inner surface of said switching actuator being made uneven.

3. The circuit breaker of claim 1, wherein a third terminal is provided for connection with a common line, and said light emitting means includes a resistor and a neon tube connected in series with each other and connected between said second and third terminals.

4. The circuit breaker of claim 1, wherein said light emitting means includes a semiconductor light emitting element.

5. The circuit breaker of claim 4, wherein said actuation surface of said switching actuator has a window and said light emitting means is fitted in window.

6. The circuit breaker of claim 1, wherein said drive means has a drive lever coupled with said actuating lever in a manner to form an H-letter configuration, the upper end portions of said drive lever and said actuating lever being held by means provided on the underside of said switching actuator integrally therewith.

* * * * *